US008267644B2

(12) United States Patent
Nishida et al.

(10) Patent No.: US 8,267,644 B2
(45) Date of Patent: Sep. 18, 2012

(54) MULTISTAGE CENTRIFUGAL COMPRESSOR

(75) Inventors: Hideo Nishida, Tokyo (JP); Hiromi Kobayashi, Tokyo (JP); Masanori Tanaka, Tokyo (JP); Tetsuya Kuwano, Tokyo (JP); Toshio Itou, Tokyo (JP); Takanori Shibata, Hitachinaka (JP); Manabu Yagi, Tsuchiura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 575 days.

(21) Appl. No.: 12/511,743

(22) Filed: Jul. 29, 2009

(65) Prior Publication Data

US 2010/0028141 A1 Feb. 4, 2010

(30) Foreign Application Priority Data

Jul. 30, 2008 (JP) ..... 2008-195817

(51) Int. Cl.
*F04D 29/44* (2006.01)

(52) U.S. Cl. ..... 415/198.1; 415/199.1; 415/199.2; 415/199.3; 415/199.6; 415/208.3; 415/211.1; 415/211.2

(58) Field of Classification Search ..... 415/198.1, 415/199.1, 199.2, 199.3, 199.6, 208.1, 208.2, 415/208.3, 211.1, 211.2; 416/198 A, 201 R
See application file for complete search history.

(56) References Cited

U.S. PATENT DOCUMENTS 3,927,763 A * 12/1975 Strub et al. ..... 206/319
4,715,778 A * 12/1987 Katayama et al. ..... 415/104
4,938,661 A * 7/1990 Kobayashi et al. ..... 415/199.1

FOREIGN PATENT DOCUMENTS

DE 3835341 A1 * 4/1990
JP 8-284892 A 10/1996
JP 2006-63895 A 3/2006

* cited by examiner

*Primary Examiner* — Igor Kershteyn
(74) *Attorney, Agent, or Firm* — Crowell & Moring LLP

(57) ABSTRACT

In a multistage centrifugal compressor, a plurality of impellers is attached to the same rotary shaft. Vaned Diffusers and vaneless diffusers are used, as diffusers, for respective compressor stages configuring the compressor. The vaned diffusers are continuously used from the first compressor stage to the middle compressor stage, and the vaneless diffusers are used for the last compressor stage and the previous stage. While high efficiency is maintained at the compressor stages having the vaned diffusers, an operating flow range is secured at the compressor stages having the vaneless diffusers.

5 Claims, 6 Drawing Sheets

SUCTION VOLUME FLOW LATE

MULTISTAGE CENTRIFUGAL COMPRESSOR

The present application claims priority from Japanese application JP2008-195817 filed on Jul. 30, 2008, the content of which is hereby incorporated by reference into this application.

The present invention relates to a centrifugal compressor, and particularly to a multistage centrifugal compressor to which a plurality of centrifugal impellers are attached to the same shaft.

An example of a conventional single-shaft multistage centrifugal compressor is described in Japanese Patent Application Laid-Open No. 2006-63895. As described in Japanese Patent Application Laid-Open No. 2006-63895, a plurality of centrifugal impellers are attached to one rotary shaft in a general multistage centrifugal compressor. In addition, a diffuser is provided on the downstream side of each impeller, and a return channel is provided on the downstream side of each diffuser. The impeller, the diffusers and the return channel (except the last stage) configure compressor stage. A suction nozzle is provided on the upstream side of the first compressor stage, and a scroll and a discharge nozzle are provided, instead of the return channel, on the downstream side of the last compressor stage. In the multistage centrifugal compressor described in Japanese Patent Application Laid-Open No. 2006-63895, vaned diffusers, as diffusers, are provided at all the compressor stages. It should be noted that vaneless diffusers have been used in many cases from the past for all the compressor stages.

Another example of the conventional centrifugal compressor is described in Japanese Patent Application Laid-Open No. H8-284892. In the centrifugal compressor described in Japanese Patent Application Laid-Open No. H8-284892, only two compressor stages are provided unlike the compressor described in Japanese Patent Application Laid-Open No. 2006-63895. The first compressor stage is provided with a vaned diffuser and the second compressor stage is provided with a vaneless diffuser.

If the vaneless diffusers are provided at all the compressor stages in the multistage centrifugal compressor, an operating flow range can be advantageously widened, whereas the efficiency is disadvantageously decreased. On the other hand, as described in Japanese Patent Application Laid-Open No. 2006-63895, the efficiency can be advantageously enhanced in the multistage centrifugal compressor in which the vaned diffusers are provided at all the compressor stages. However, the operating flow range is narrowed down in some cases, as compared to the multistage centrifugal compressor for which the vaneless diffusers are used.

In a two-stage centrifugal compressor described in Japanese Patent Application Laid-Open No. H8-284892, a hollow chamber is formed at a vaned diffuser portion of the first compressor stage, and a surging point is moved to the small flow rate side by spraying a pressured gas from the hollow chamber. Accordingly, the performance of the first compressor stage is improved. However, since matching with the performance of the other compressor stages is not much considered, it is difficult to apply to the multistage centrifugal compressor.

BRIEF SUMMARY OF THE INVENTION

The present invention has been achieved in view of the problems of the above-described conventional technique, and an object thereof is to improve the indexes of conflicting characteristics of an operating flow range and efficiency which are indexes of the performance of a multistage compressor, or to satisfy both of high efficiency and a wide operating flow range. Another object of the present invention is to realize compressor stages having diffusers which can be applied to even a multistage compressor having three or more compressor stages.

In order to achieve the above-described objects, the present invention provides a multistage centrifugal compressor to which a plurality of impellers are attached to the same shaft, wherein the last compressor stage, or each of the last compressor stage and the previous compressor stage includes a vaneless diffuser, and each of the other compressor stages includes a vaned diffuser.

In the multistage centrifugal compressor, the outlet blade angle of each impeller included in the compressor stages having the vaneless diffusers may be made smaller than that of the corresponding impeller of the compressor stage having the vaned diffuser arranged immediately before the compressor stage having the vaneless diffuser, and the outlet radius of the diffuser of the last compressor stage may be made larger than that of the diffuser of the compressor stage immediately before the last compressor stage.

In addition, the channel width in the axis direction of the vaneless diffuser included in the last compressor stage may be narrowed down near the outlet, and it is preferable that two or more compressor stages having the vaned diffusers are continuously provided from the first compressor stage. It should be noted that the compressor includes three or more compressor stages.

According to the present invention, in the single-shaft multistage compressor having three or more compressor stages, diffusers used from the first compressor stage to the previous stage of the last compressor stage, or to the previous stage of the last compressor stage and the compressor stage immediately before the previous stage of the last compressor stage are provided as vaned diffusers. Since the vaneless diffuser is provided only at the last compressor stage, or at each of the last compressor stage and the previous compressor stage, an operating flow range can be secured at the compressor stages on the downstream side which largely affect the surge flow rate and the choke flow rate, and an operating flow range can be enlarged without decreasing the efficiency of the multistage centrifugal compressor. Further, when the operating flow range of the multistage centrifugal compressor is set similar to that of the conventional compressor, its efficiency can be improved.

BRIEF DESCRIPTION OF THE SEVERAL VIEWS OF THE INVENTION

DETAILED DESCRIPTION OF THE INVENTION

Figure 5:
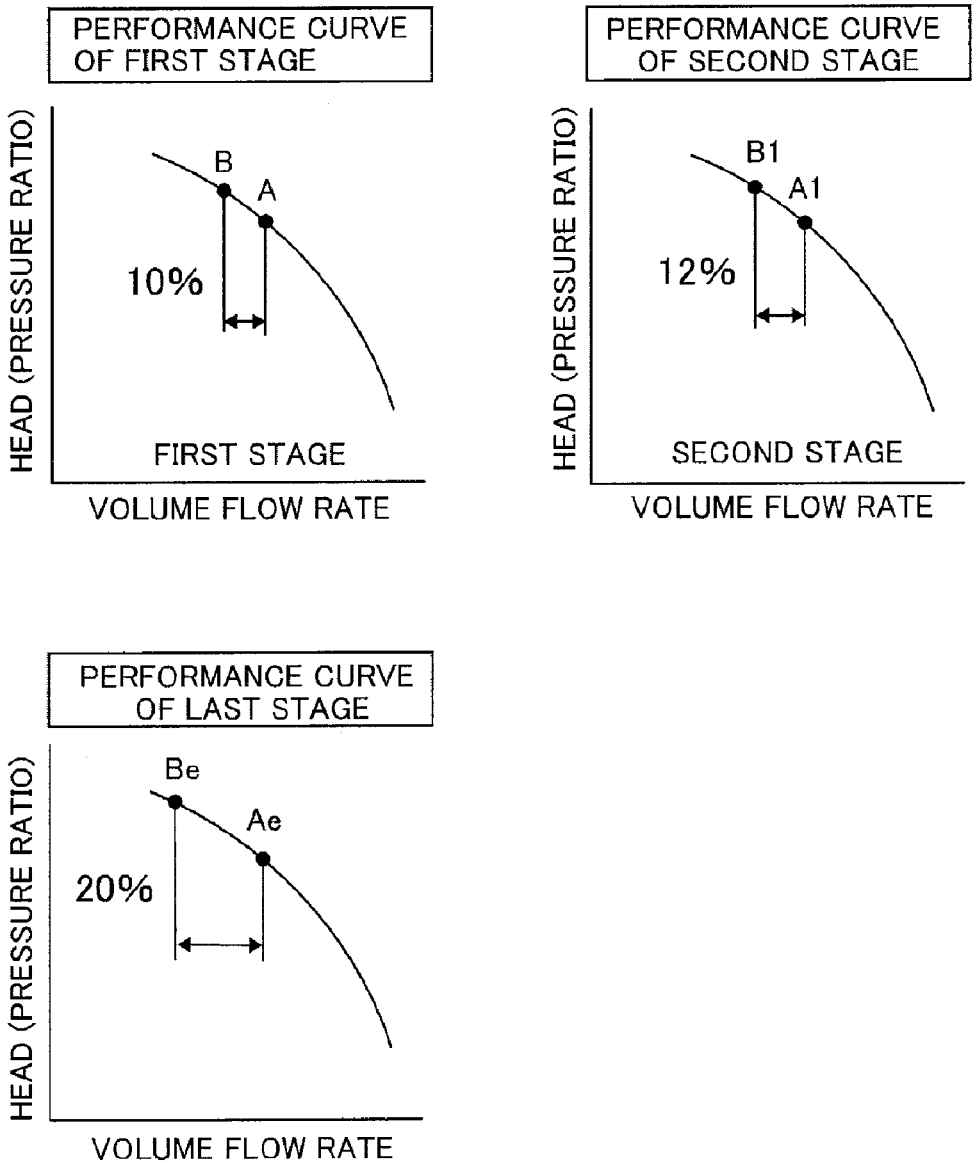
FIG. 5 is a view for explaining an operation point of each stage of the multistage centrifugal compressor.

An example of a performance curve of each compressor stage in a centrifugal compressor including multiple stages is shown in FIG. 5. As being apparent from FIG. 5, if an operating point is moved in the direction where the volume flow of the first compressor stage is decreased in the centrifugal compressor, a head (pressure ratio) of the first compressor stage is increased. As a result, outlet pressure of the first compressor stage, namely, inlet pressure of the second compressor stage is increased. Since the pressure of the inlet is increased, an inlet fluid density becomes high at the second compressor stage.

That is, the decreased amount of the volume flow rate (equal to mass flow/inlet density) of the second compressor stage becomes larger than that of the first compressor stage. Thereafter, the decreased amount of the volume flow rate sequentially becomes larger towards the latter stages, and the decreased amount of the last compressor stage is maximized. For this reason, surge occurs at the last compressor stage at first in the multistage centrifugal compressor, assuming that the operating range (operating limit) on the small flow rate side is the same in all the compressor stages.

On the other hand, if the mass flow of the first compressor stage is increased, the head of the first compressor stage is decreased, and outlet pressure of the first compressor stage, namely, inlet pressure of the second compressor stage is decreased. Accordingly, the inlet fluid density of the second compressor stage is decreased, and the increased amount of the volume flow rate (equal to mass flow/inlet density) of the second compressor stage becomes much larger than that of the first compressor stage. Thereafter, the increased amount of the volume flow rate sequentially becomes larger towards the latter stages, and the increased amount of the last compressor stage is maximized. Accordingly, the last compressor stage is choked at first in the multistage centrifugal compressor, assuming that the operating flow range (operating limit) on the large flow rate side is the same in all the compressor stages.

As described above, the operating flow range of the multistage centrifugal compressor is determined by the last compressor stage. The operating flow range of the centrifugal compressor using vaneless diffusers becomes wider than that of the centrifugal compressor using vaned diffusers in many cases, and efficiency of the compressor using vaned diffusers is higher than that of the compressor using vaneless diffusers. It can be understood from the above-mentioned fact that the surge flow rate and the choke flow rate are largely affected towards the latter compressor stages.

In order to secure the flow range (operating range), the vaneless diffusers are used for a few continuous stages towards upstream side from the last compressor stage, and the vaned diffusers are used for a plurality of continuous stages from the first compressor stage towards the downstream side in order to secure the efficiency. The efficiency of the centrifugal compressor corresponds to a mean value of the efficiencies of the respective compressor stages. Accordingly, if the number of the vaned diffusers is small, the efficiency is largely decreased. Therefore, in consideration of the operating range of the centrifugal compressor, the vaneless diffuser is provided only at the last compressor stage or at each of the last compressor stage and the compressor stage immediately before the last one.

Further, if the vaneless diffusers and impellers (impellers with small outlet blade angles measured from the circumferential direction line) in each of which a stage reaction degree, namely, a ratio of a pressure rise in the impeller to that of compressor stage including the impeller is high, and the operating flow range is wide, are applied to the above-described configuration, the efficiency can be improved. If the outlet radius of the diffuser of the last compressor stage is made larger, the efficiency can be further improved.

Figure 1:
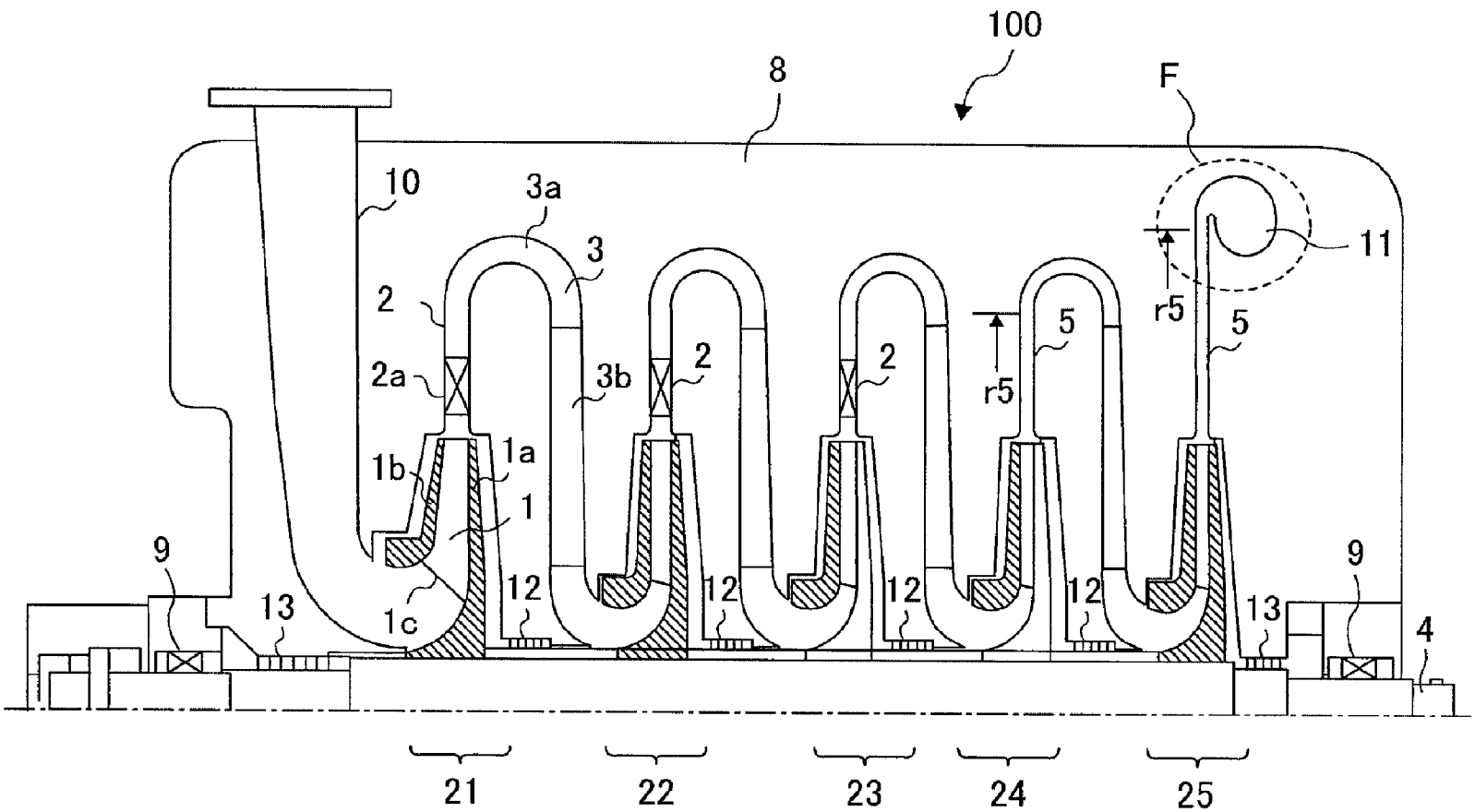
FIG. 1 is a longitudinal cross-sectional view of an embodiment of a multistage centrifugal compressor according to the present invention.
Figure 2:
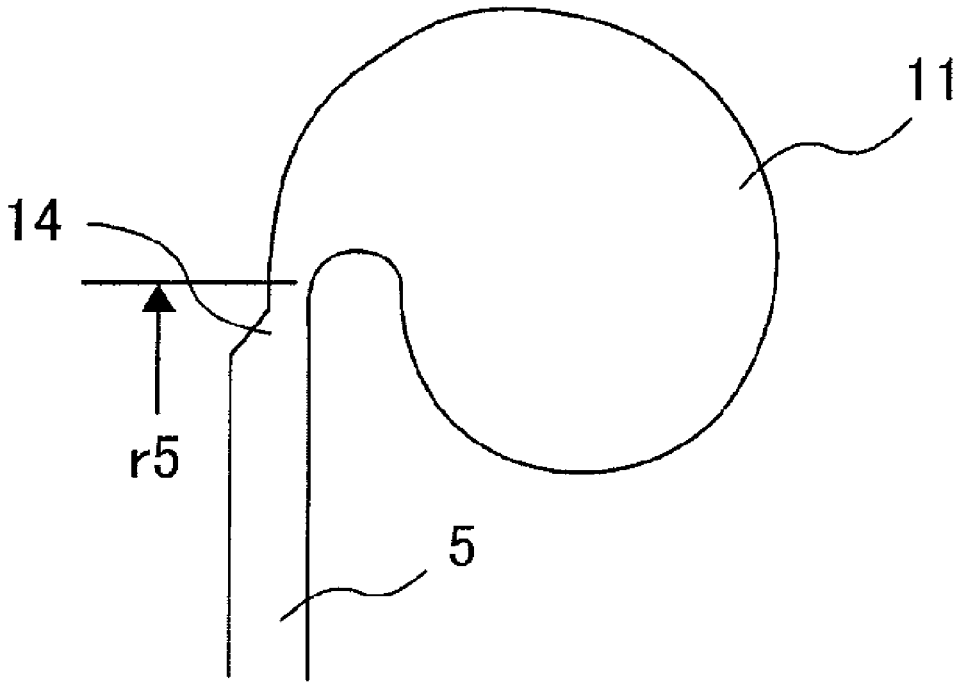
FIG. 2 is an enlarged view of a portion F of FIG. 1, and is a view for explaining a discharge portion of the last compressor stage.
Figure 3:
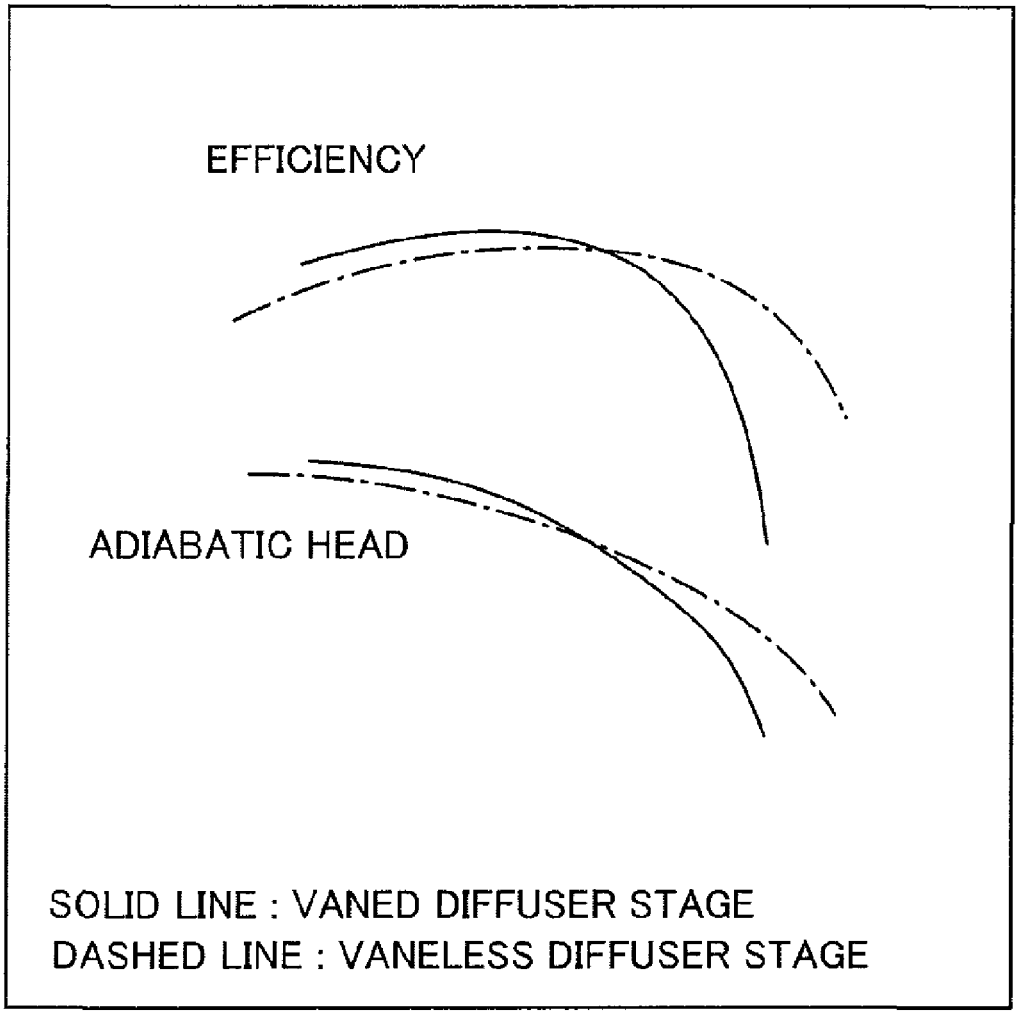
FIG. 3 is a view for explaining performance comparison between compressor stages having vaneless diffusers and compressor stages having vaned diffusers.
Figure 4:
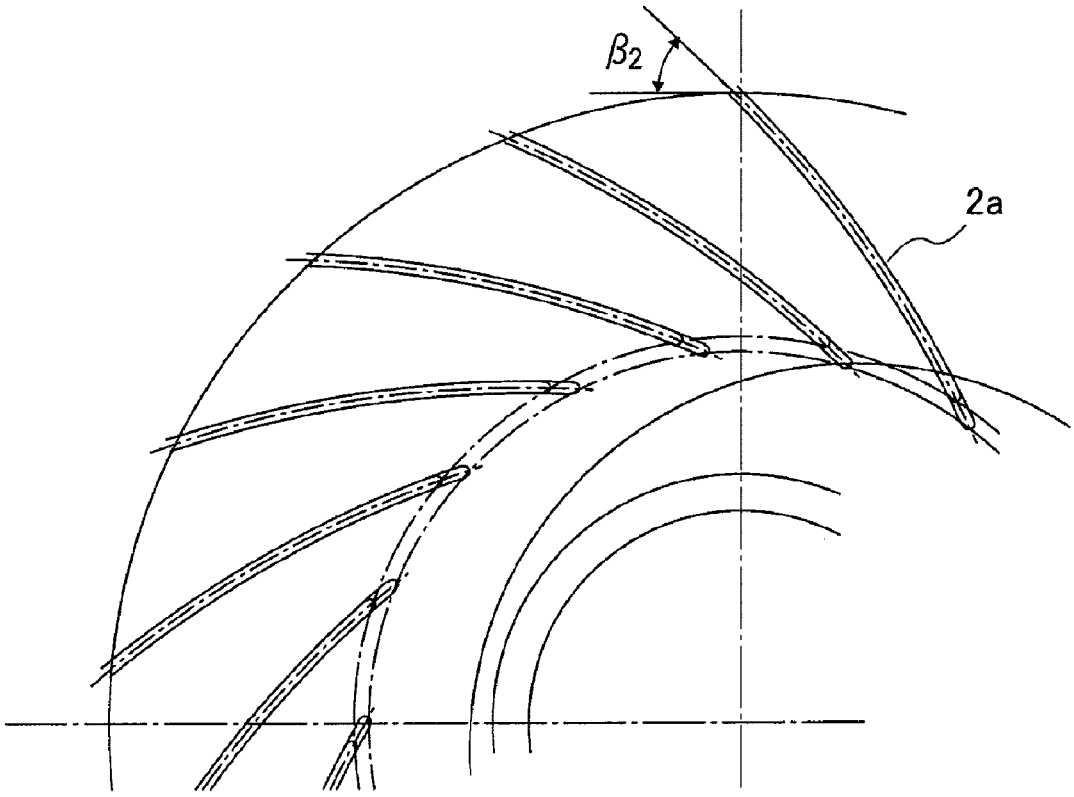
FIG. 4 is a view for explaining a blade angle at an outlet of an impeller.

An embodiment of the multistage centrifugal compressor according to the present invention based on such a finding will be described using the drawings. As an example of the multistage centrifugal compressor, a longitudinal cross-sectional view of a five-stage centrifugal compressor 100 is shown in FIG. 1. A longitudinal cross-sectional view of a diffuser outlet portion in a last compressor stage 25 is shown in FIG. 2. A typical example of performance curves of compressor stages having vaned diffusers and those having vaneless diffusers are shown in FIG. 3. A horizontal cross-sectional view of a part of an impeller is shown in FIG. 4 for explanation of a blade outlet angle β2 of an impeller 1. An example of performance curves in respective compressor stages 21, 22, and 25 is shown in FIG. 5. Hereinafter, the present invention will be described by using these drawings as needed.

As shown in FIG. 1, the impellers 1, each including a hub plate 1*a* formed in a disk shape, a shroud plate 1*b* formed in a ring shape, and circular cascade blades 1*c* arranged between the hub plate 1*a* and the shroud plate 1*b* in the circumferential direction at intervals, are attached to a rotary shaft 4 while being stacked. A diffuser 2 is provided outside in the radius direction of each impeller 1.

A return channel 3 having a bend portion 3*a* which is coupled to an outlet portion of each diffuser 2 is arranged on the outer side and on the downstream side in the axis direction of each diffuser. A plurality of guide blades 3*b* are arranged, in the circumferential direction at intervals, at the positions on the downstream side in the axis direction relative to the diffusers 2.

The compressor stages 21 to 25, each including the impeller 1, the diffuser 2, and the return channel 3, are sequentially stacked in the axis direction from the first compressor stage 21 to configure the multistage centrifugal compressor 100. A suction nozzle 10 for guiding a gas is provided on the inlet side of the first compressor stage 21. Instead of the return channel, a discharge scroll 11 which collects a gas to be guided to the outside of the multistage centrifugal compressor 100 is provided at the last compressor stage 25.

The rotary shaft 4 to which a plurality of impellers 1 are attached is rotatably supported by bearings 9 provided near both ends of the rotary shaft 4. A casing 8 which forms a wall surface of the diffusers 2 and the return channels 3 and is divided into two in the horizontal direction is arranged outside the impellers 1. Between the casing 8 and the rotary shaft 4, there are attached, on the casing 8 side, labyrinth seals 12 for preventing an operating gas from leaking among the respective constituent elements arranged inside the multistage centrifugal compressor 100 and labyrinth seals 13 for preventing the operating gas from leaking from the inside of the multistage centrifugal compressor 100 to the outside thereof.

The vaned diffuser 2 with guide blades 2*a* is arranged at each outlet of the impellers 1 between the first compressor stage 21 and the third compressor stage 23. A vaneless diffuser 5 without guide blades is arranged at each of the fourth compressor stage 24 and the last compressor stage 25. For the first compressor stage 21 to the third compressor stage 23, there are used the impellers 1, each having a large outlet blade angle P2 represented by an angle measured from the circumferential direction line (tangent line) (see FIG. 4). For the fourth compressor stage 24 and the last compressor stage 25, there are used the impellers 1, each having a small outlet blade angle P2. An outlet radius r5 of the diffuser 5 of the last compressor stage 25 is larger than those of the other compressor stages. The channel of the diffuser 5 of the last compressor stage 25 is narrowed down at an outlet portion 14 in the width direction (see FIG. 2).

The multistage centrifugal compressor 100 thus configured is operated in the following manners. The operation gas is sucked from the suction nozzle 10, and its pressure is boosted by the impeller 1 of the first compressor stage 21. Thereafter, the gas is decelerated in the diffuser 2 to boost its static pressure. The gas passing through the diffuser 2 is guided to the return channel 3 to flow inward in the radius direction, and then flows in the impeller 1 of the next stage as the flow in the axis direction. Thereafter, the high-pressure operation gas compressed through the similar route from the second compressor stage 22 to the fourth compressor stage 24 flows in the impeller 1 of the last compressor stage 25 from the axis direction. The operation gas is further compressed by the impeller 1 of the last compressor stage 25, and the pressure thereof is recovered by the diffuser 5. Then, the operation gas is collected at the discharge scroll 11 to be discharged to the outside of the multistage centrifugal compressor 100 through a pipe (not shown).

Figure 6:
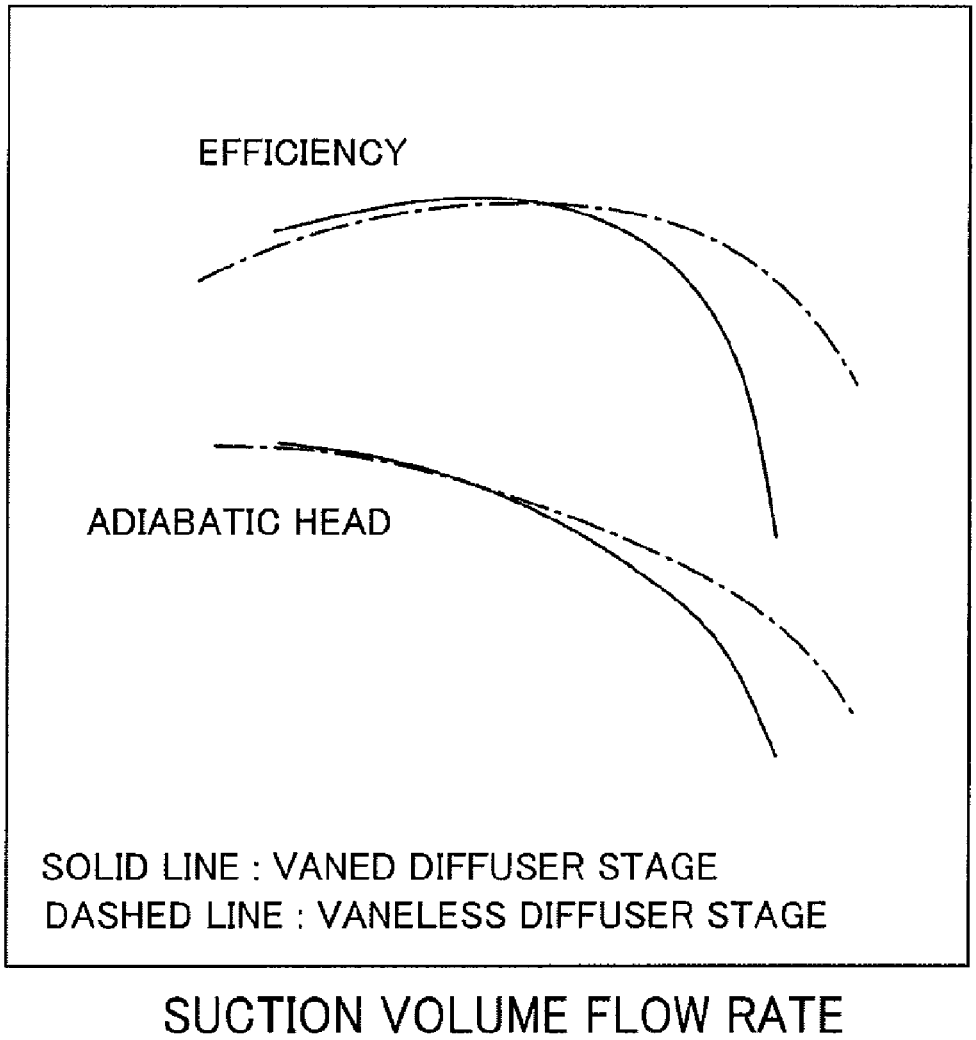
FIG. 6 is a view for explaining influence on the overall performance caused by the vaned diffusers and the vaneless diffusers.

As described above, the operating flow range of the multistage centrifugal compressor 100 is determined on the basis of the performance on the latter stage side including the last compressor stage. Since the vaneless diffusers 5 are provided at the last compressor stage 25 and the previous stage 24 in the embodiment, the multistage centrifugal compressor 100 can secure a wide operating flow range, as compared to a case in which all the compressor stages 21 to 25 are provided with the vaned diffusers 2. This state will be shown in FIG. 6. FIG. 6 shows performance curves representing changes of the overall efficiency and the overall adiabatic head depending on a suction flow rate for the case in which the vaneless diffusers 5 are used for the last compressor stage and the previous stage and the case in which the vaned diffusers 2 are used for all stages.

Further, the impellers 1, each having a small outlet blade angle for securing a wide operating flow range, are used for the last compressor stage 25 and the previous stage 24, and thus a much wider operating flow range can be secured. Since the channel width of the diffuser of the last compressor stage 25 is narrowed down on the outlet side, stall in the diffuser 5 is suppressed, and a wider operating flow range can be achieved, as compared to a case in which the channel width is not narrowed down.

As shown in FIG. 3, the usage of the vaneless diffusers 5 leads to decrease in the efficiency of the compressor. However, according to the embodiment, since the impellers, each having a small outlet blade angle with a high stage reaction, are employed for the last compressor stage 25 and the previous stage 24, and the outlet radius r5 of the diffuser 5 of the last compressor stage 25 is made larger, the efficiency similar to the case in which the vaned diffusers 2 are provided for all stages can be secured. That is, since the vaneless diffusers 5 are provided at the last compressor stage and the previous stage which largely affect the surge flow and the choke flow, and the high-efficiency vaned diffusers 2 are provided at the other stages, a wide operating flow range can be secured while maintaining the efficiency of the compressor.

The vaneless diffusers 5 are employed for both of the last compressor stage and the previous stage in the embodiment. However, it is obvious that if further improvement of efficiency is required, the vaneless diffuser 5 may be provided only at the last compressor stage. Furthermore, the embodiment was described using an example of the 5-stage compressor. However, the number of stages is not limited to 5, but may be 3 or more. It should be noted that for three stages, it is practical to use the vaneless diffuser 5 only at the last compressor stage because efficiency is not decreased. In other words, it is desirable from the viewpoint of improvement of efficiency that the vaned diffusers 2 are used for two or more continuous stages from the first compressor stage. Further, the outlet blade angle of the impeller of only the last compressor stage may be made small to secure the operating flow range.

What is claimed is:

1. A multistage centrifugal compressor to which a plurality of impellers are attached to the same shaft, wherein at least one of the last compressor stage and the previous compressor stage comprises a vaneless diffuser, each of the other compressor stages comprises a vaned diffuser, and an outlet blade angle of each impeller included in the at least one of the last compressor stage and the previous compressor stage is made smaller than that of a corresponding impeller of one of the other compressor stages that is arranged immediately before the at least one of the last compressor stage and the previous compressor stage.

2. The multistage centrifugal compressor according to claim 1, wherein an outlet radius of the diffuser of the last compressor stage is made larger than that of the diffuser of the compressor stage immediately before the last compressor stage.

3. The multistage centrifugal compressor according to claim 2, wherein the channel width in the axis direction of the vaneless diffuser included in the last compressor stage is narrowed down near an outlet.

4. The multistage centrifugal compressor according to claim 2, wherein the channel width in the axis direction of the vaneless diffuser included in the last compressor stage is narrowed down near the outlet.

5. The multistage centrifugal compressor according to claim 1, wherein three or more compressor stages are provided.

* * * * *